US006343783B1

(12) United States Patent
Ke

(10) Patent No.: US 6,343,783 B1
(45) Date of Patent: Feb. 5, 2002

(54) WORKBENCH

(76) Inventor: Harrison Ke, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/659,424

(22) Filed: Sep. 6, 2000

(30) Foreign Application Priority Data

Mar. 14, 2000 (TW) ..... 089204022

(51) Int. Cl.[7] ..... B25B 1/02
(52) U.S. Cl. ..... 269/139; 269/184
(58) Field of Search ..... 269/139, 184, 269/185, 186, 187, 901

(56) References Cited

U.S. PATENT DOCUMENTS 922,336 A * 4/1909 Rivers ..... 269/184
2,372,727 A * 4/1945 Manning ..... 269/184
5,127,639 A * 7/1992 Tucker et al. ..... 269/139
6,135,435 A * 10/2000 Schmitz ..... 269/185

* cited by examiner

*Primary Examiner*—Robert C. Watson

(57) ABSTRACT

A workbench has a bench frame, a rack seat disposed on the bench frame, and a screw rod passing through the rack seat, a positioning block, a hollow shaft, a coiled spring, and a T-shaped sleeve. The rack seat has a slide slot. The T-shaped sleeve, the hollow shaft, the coiled spring, and the positioning block are disposed in the slide slot of the rack seat. A first sliding seat is disposed on the T-shaped sleeve. A second sliding seat is disposed on the positioning block. A first clamping block has a first bottom post inserted in the first panel. A second clamping block has a second bottom post inserted in the second panel. A first rivet passes through the first panel, the first sliding seat, and the T-shaped sleeve. A second rivet passes through the second panel, the second sliding seat, and the positioning block.

3 Claims, 8 Drawing Sheets

WORKBENCH

BACKGROUND OF THE INVENTION

The present invention relates to a workbench. More particularly, the present invention relates to a workbench which is operated very fast.

A conventional workbench has a fixed clamping block and a movable clamping block which is driven by a screw rod. It is cumbersome to rotate the screw rod until the fixed clamping block and the movable clamping block clamp an article tightly.

SUMMARY OF THE INVENTION

An object of the present invention is to provide a workbench which can be operated very fast.

Accordingly, a workbench comprises a bench frame, a rack seat disposed on the bench frame, a screw rod, a positioning block, a first sliding seat, a second sliding seat, a first panel, a second panel, a first clamping block, a second clamping block, and a handle bar. The rack seat has a through hole and a slide slot. A T-shaped sleeve, a hollow shaft, a coiled spring, and the positioning block are disposed in the slide slot of the rack seat. The T-shaped sleeve has a threaded hole and a threaded aperture. The screw rod has a distal end. The screw rod passes through the through hole of the rack seat, the positioning block, the hollow shaft, the coiled spring, and the threaded hole of the T-shaped sleeve. The distal end of the screw rod is connected to the handle bar. The positioning block has a plurality of inner grooves, and two rows of inner serrations. The hollow shaft has two rows of outer teeth. The first sliding seat is disposed on the T-shaped sleeve. The second sliding seat is disposed on the positioning block. The first panel has a first round hole and a first through aperture. The second panel has a second round hole and a second through aperture. The first clamping block has a first bottom post inserted in the first round hole of the first panel. The second clamping block has a second bottom post inserted in the second round hole of the second panel. A first rivet passes through the first through aperture of the first panel, the first sliding seat, and the threaded aperture of the T-shaped sleeve. A second rivet passes through the second through aperture of the second panel, the second sliding seat, and the positioning block. The shaft engages with the positioning block.

DETAILED DESCRIPTION OF THE INVENTION

Figure 1:
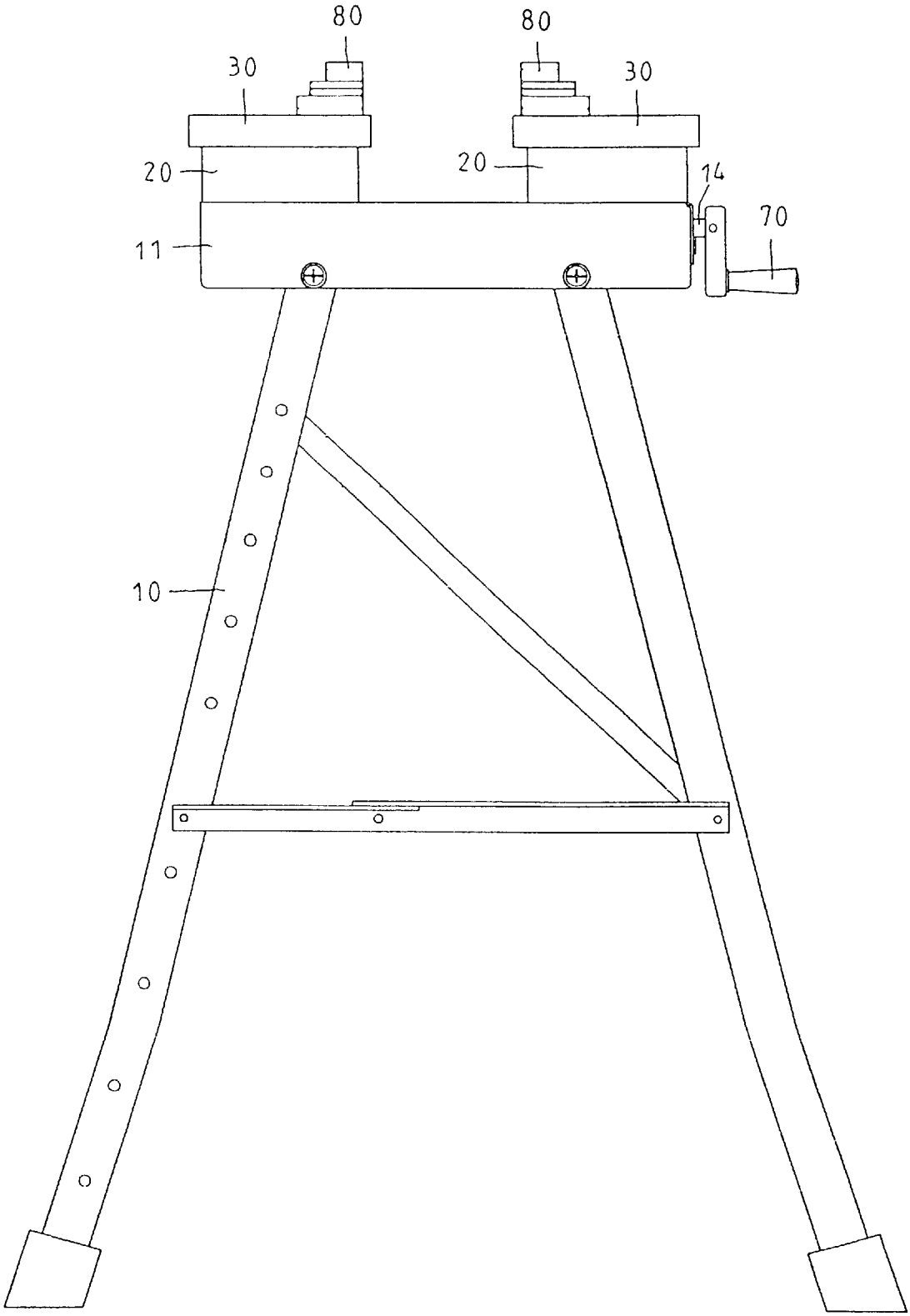
FIG. 1 is an elevational view of a workbench of a preferred embodiment in accordance with the present invention.
Figure 2:
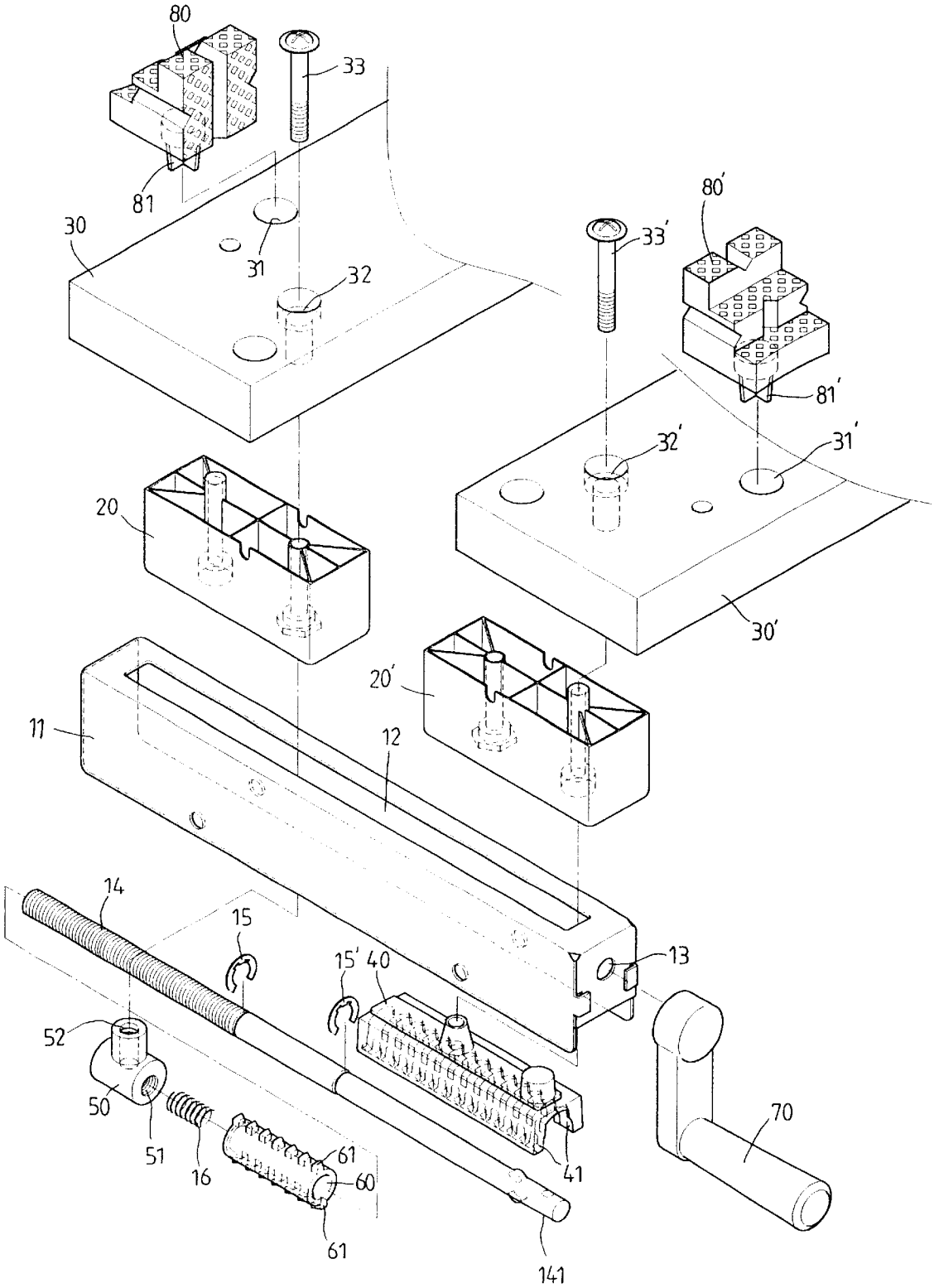
FIG. 2 is a partially perspective exploded view of a workbench of a preferred embodiment in accordance with the present invention.
Figure 2A:
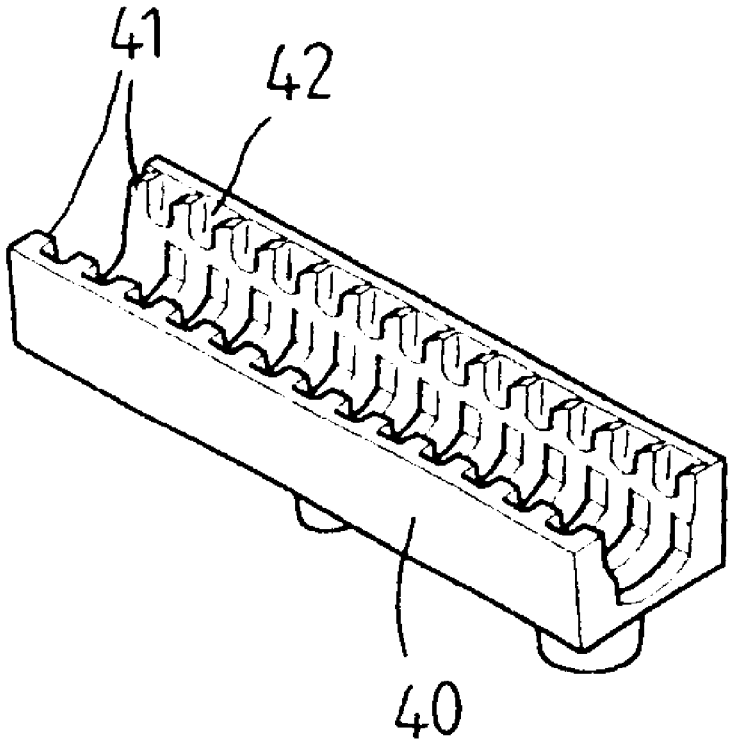
FIG. 2A is a perspective view of a positioning block of a preferred embodiment in accordance with the present invention.
Figure 3:
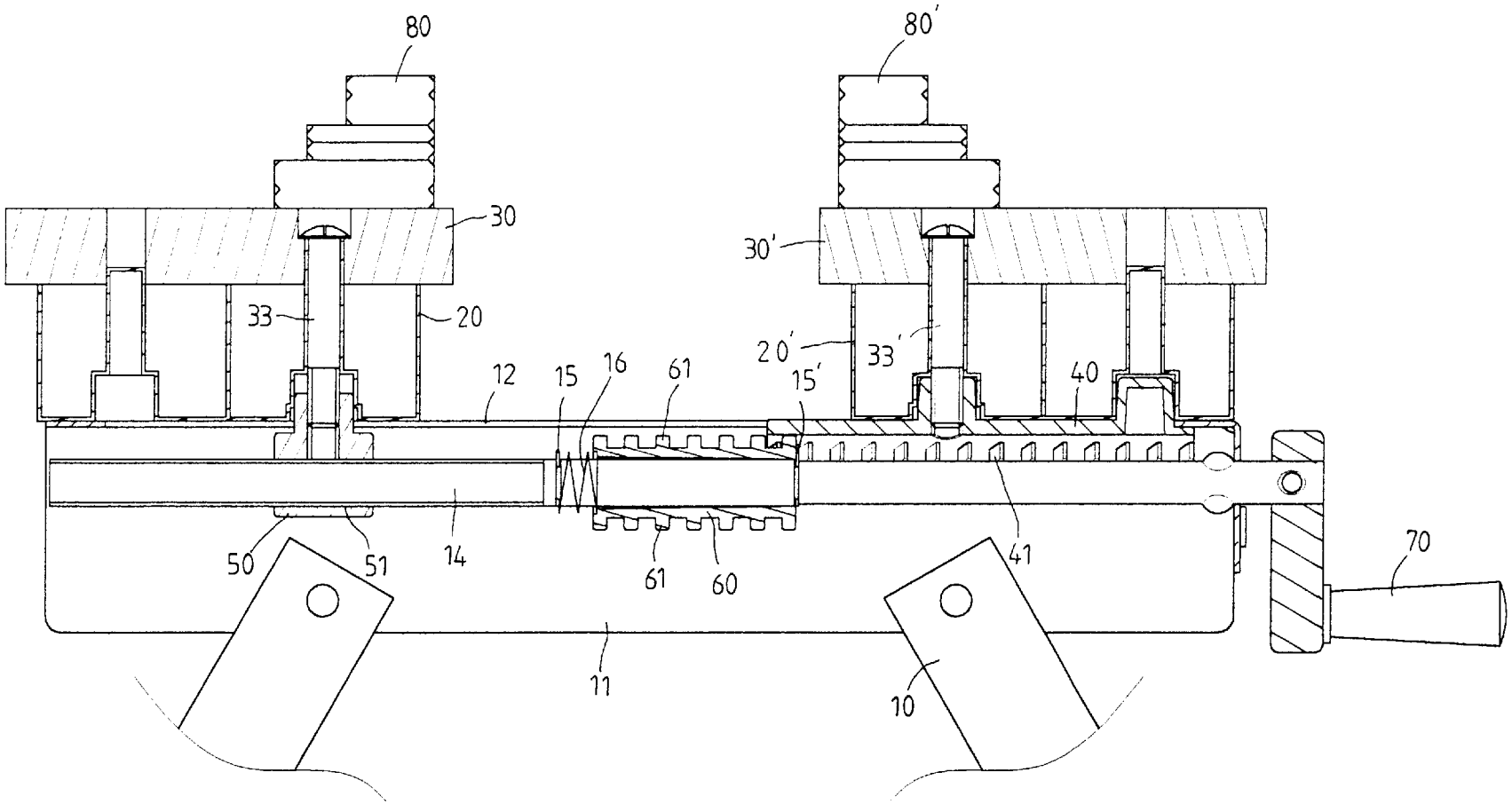
FIG. 3 is a partially sectional assembly view of a workbench of a preferred embodiment in accordance with the present invention.

Referring to FIGS. 1 to 5A, a workbench comprises a bench frame 10, a rack seat 11 disposed on the bench frame 10, a screw rod 14, a positioning block 40, a first sliding seat 20, a second sliding seat 20', a first panel 30, a second panel 30', a first clamping block 80, a second clamping block 80', and a handle bar 70.

The rack seat 11 has a through hole 13 and a slide slot 12.

A T-shaped sleeve 50, a hollow shaft 60, a coiled spring 16, and the positioning block 40 are disposed in the slide slot 12 of the rack seat 11.

The T-shaped sleeve 50 has a threaded hole 51 and a threaded aperture 52.

The screw rod 14 has a distal end 141.

The screw rod 14 passes through the through hole 13 of the rack seat 11, the positioning block 40, the hollow shaft 60, the coiled spring 16, and the threaded hole 51 of the T-shaped sleeve 50.

The distal end 141 of the screw rod 14 is connected to the handle bar 70.

The positioning block 40 has a plurality of inner grooves 42, and two rows of inner serrations 41.

The hollow shaft 60 has two rows of outer teeth 61.

A first C-shaped retainer 15 is disposed on the screw rod 14 to block the coiled spring 16.

A second C-shaped retainer 15' is disposed on the screw rod 14 to block the hollow shaft 60.

The first sliding seat 20 is disposed on the T-shaped sleeve 50.

The second sliding seat 20' is disposed on the positioning block 40.

The first panel 30 has a first round hole 31 and a first through aperture 32.

The second panel 30' has a second round hole 31' and a second through aperture 32'.

The first clamping block 80 has a first bottom post 81 inserted in the first round hole 31 of the first panel 30.

The second clamping block 80' has a second bottom post 81' inserted in the second round hole 31' of the second panel 30'.

A first rivet 33 passes through the first through aperture 32 of the first panel 30, the first sliding seat 20, and the threaded aperture 52 of the T-shaped sleeve 50.

A second rivet 33' passes through the second through aperture 32' of the second panel 30', the second sliding seat 20', and the positioning block 40.

The shaft 60 engages with the positioning block 40.

Figure 4:
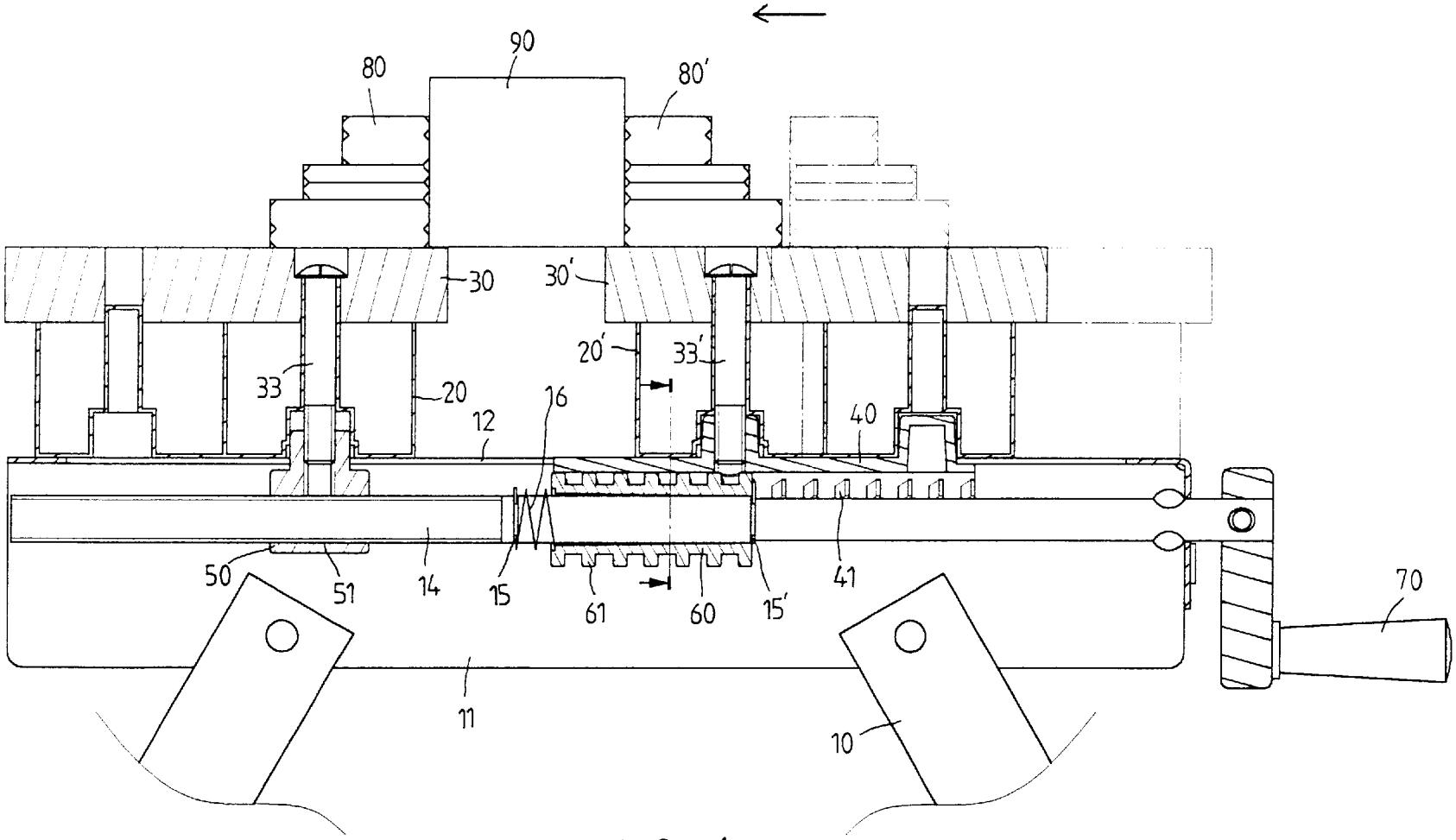
FIG. 4 is a schematic view illustrating a fast positioning operation of a workbench of a preferred embodiment in accordance with the present invention.
Figure 4A:
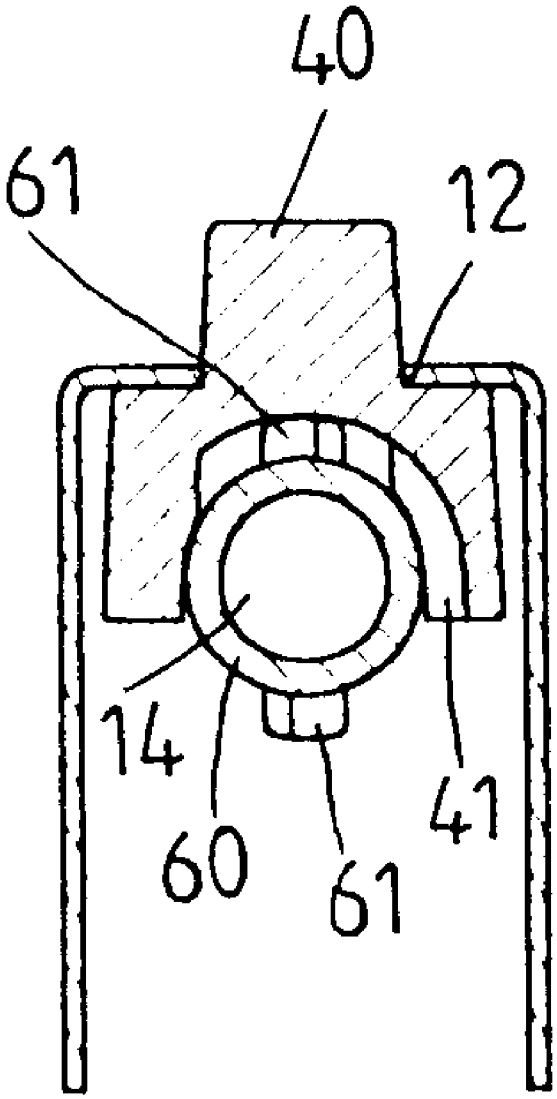
FIG. 4A is a sectional view taken along line 4B—4B in FIG. 4.

When the handle bar 70 drives the screw rod 14 to rotate counterclockwise, the outer teeth 61 of the hollow shaft 60 disengages from the groove 42 of the positioning block 40. Then the positioning block 40, the second sliding seat 20', and the second panel 30' will be moved fast. The first clamping block 80 and the second clamping block 80' will clamp an article 90 (as shown in FIG. 4).

Figure 5:
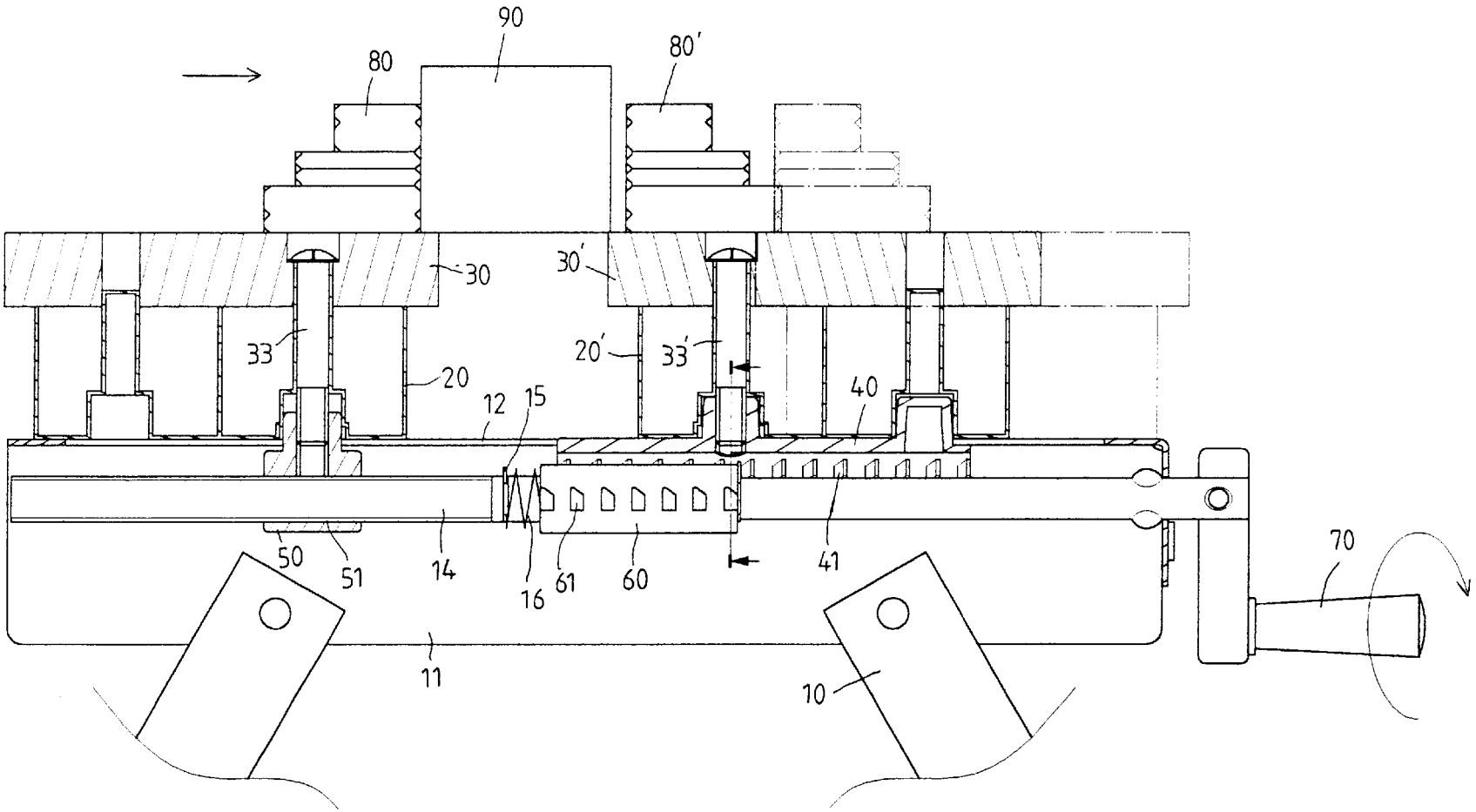
FIG. 5 is a schematic view illustrating a fast clamping operation of a workbench of a preferred embodiment in accordance with the present invention.
Figure 5A:
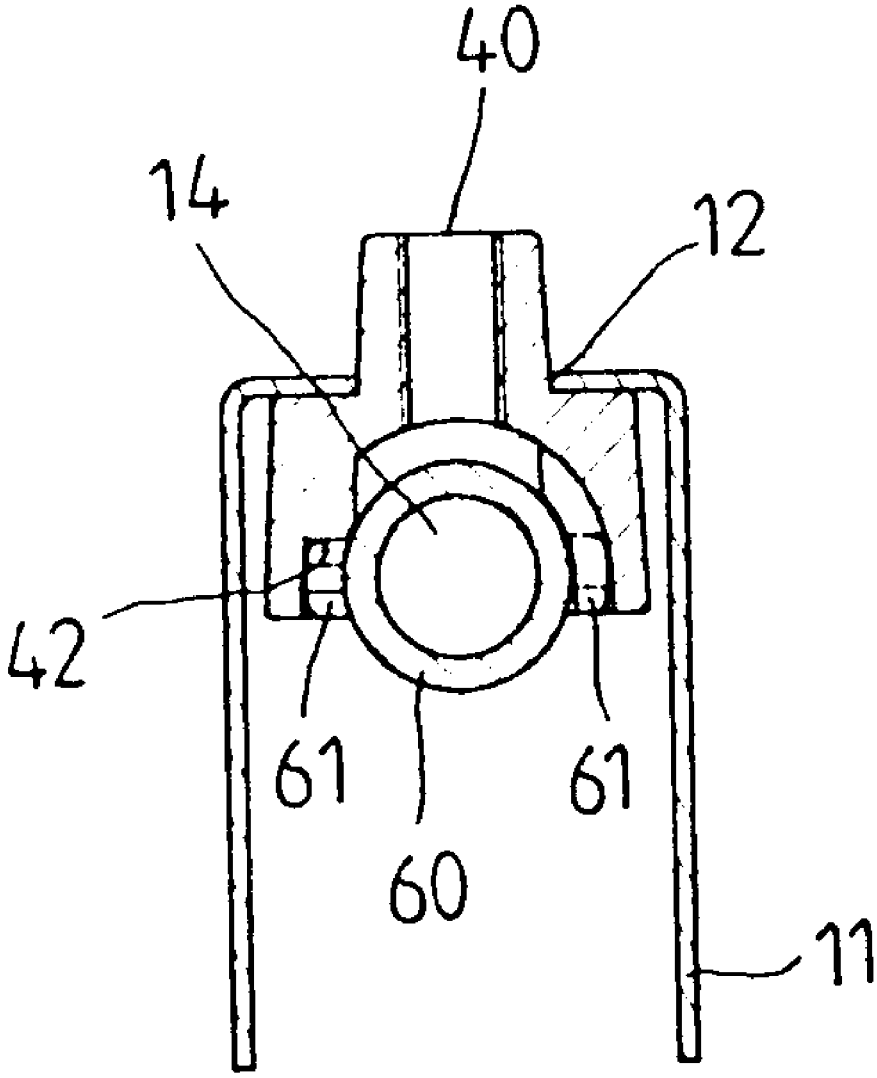
FIG. 5A is a sectional view taken along line 5V—5V in FIG. 5.

When the handle bar 70 drives the screw rod 14 to rotate clockwise, the outer teeth 61 of the hollow shaft 60 engages with the groove 42 of the positioning block 40. Then the first clamping block 80 and the second clamping block 80' will clamp the article 90 tightly (as shown in FIG. 5).

The present invention is not limited to the above embodiment but various modification thereof may be made. Furthermore, various changes in form and detail may be made without departing from the scope of the present invention.

I claim:

1. A workbench comprises:

a bench frame, a rack seat disposed on the bench frame, a screw rod, a positioning block, a first sliding seat, a second sliding seat, a first panel, a second panel, a first clamping block, a second clamping block, and a handle bar, the rack seat having a through hole and a slide slot, a T-shaped sleeve, a hollow shaft, a coiled spring, and the positioning block being disposed in the slide slot of the rack seat, the T-shaped sleeve having a threaded hole and a threaded aperture, the screw rod having a distal end, the screw rod passing through the through hole of the rack seat, the positioning block, the hollow shaft, the coiled spring, and the threaded hole of the T-shaped sleeve, the distal end of the screw rod connected to the handle bar, the positioning block having a plurality of inner grooves, and two rows of inner serrations, the hollow shaft having two rows of outer teeth, the first sliding seat disposed on the T-shaped sleeve, the second sliding seat disposed on the positioning block, the first panel having a first round hole and a first through aperture, the second panel having a second round hole and a second through aperture, the first clamping block having a first bottom post inserted in the first round hole of the first panel, the second clamping block having a second bottom post inserted in the second round hole of the second panel, a first rivet passing through the first through aperture of the first panel, the first siding seat, and the threaded aperture of the T-shaped sleeve, a second rivet passing through the second through aperture of the second panel, the second sliding seat, and the positioning block, and the shaft engaging with the positioning block.

2. The workbench as claimed in claim 1, wherein a first C-shaped retainer is disposed on the screw rod to block the coiled spring.

3. The workbench as claimed in claim 2, wherein a second C-shaped retainer is disposed on the screw rod to block the hollow shaft.

* * * * *